US006072437A

United States Patent [19]

Zimmerman et al.

[11] Patent Number: 6,072,437

[45] Date of Patent: Jun. 6, 2000

[54] ANTENNA EXHIBITING AZIMUTH AND ELEVATION BEAM SHAPING CHARACTERISTICS

[75] Inventors: Kurt A. Zimmerman, Atlanta; James M. Howell, Woodstock; James P. Montgomery, Roswell, all of Ga.

[73] Assignee: EMS Technologies, Inc., Norcross, Ga.

[21] Appl. No.: 09/106,833

[22] Filed: Jun. 29, 1998

[51] Int. Cl.[7] ..... H01Q 19/06

[52] U.S. Cl. ..... 343/753; 343/754; 343/909; 343/911 R

[58] Field of Search ..... 343/753, 754, 343/756, 786, 909, 911 R, 785; H01Q 19/06

[56] References Cited

U.S. PATENT DOCUMENTS

| | | | |
|---|---|---|---|
| 2,785,397 | 3/1957 | Rust et al. | 343/753 |
| 4,065,772 | 12/1977 | Seavey | 343/786 |
| 4,660,050 | 4/1987 | Phillips | 343/753 |
| 5,642,121 | 6/1997 | Martek et al. | 343/786 |
| 5,905,457 | 5/1999 | Rashid | 343/785 |

*Primary Examiner*—Hoanganh Le
*Assistant Examiner*—Hoang Nguyen
*Attorney, Agent, or Firm*—King & Spalding

[57] ABSTRACT

Varying the azimuth and elevation beam patterns for an antenna. For a horn-type antenna implemented by a parallel-plate waveguide structure, an input port can accept an electromagnetic signal and an output slot can transmit the electromagnetic signal. An azimuth lens can be placed proximate to the output slot for adjusting the antenna beam pattern within the azimuth plane. The azimuth lens comprises two or more lens elements, each typically having a cylindrical shape and comprising a dielectric material, which support the generation of discrete beams in the azimuth plane in response to the electromagnetic signal output by the output slot. These discrete beams can sum in-phase to form a composite beam having a shape or pattern generally defined by the characteristics of the azimuth lens elements. Specifically, this composite beam has a pattern within the azimuth plane defined by the size and shape of the azimuth lens elements and the spacing between these elements. In addition, the horn-antenna can include an elevation lens that can rotate within the internal parallel-plate structure of the horn-type antenna to vary the beam pattern within the elevation plane.

22 Claims, 8 Drawing Sheets

| BEAM DEG | PEAK dB | BEAM WIDTH (DEG) |
|---|---|---|
| 0.00 | -5.21 | 7.58 |

| BEAM DEG | PEAK dB | BEAM WIDTH (DEG) |
|---|---|---|
| 0.00 | -5.23 | 7.58 |
| -1.00 | -5.24 | 7.53 |

ANTENNA EXHIBITING AZIMUTH AND ELEVATION BEAM SHAPING CHARACTERISTICS

FIELD OF THE INVENTION

This invention relates in general to an antenna for wireless communication applications and, in particular, to a horn antenna including at least a pair of lens positioned in front of the horn flare for shaping the azimuth antenna pattern and a lens placed within the horn structure for shaping the elevation antenna pattern.

BACKGROUND OF THE INVENTION

Designers of wireless communication systems, such as cellular and personal communications service (PCS), typically desire to implement a cell-based system exhibiting 360 degrees of wireless communications coverage within a predetermined geographical area of each cell. This omnidirectional communications coverage can be achieved by the use of four ninety degree half power beamwidth (HPBW) azimuth horns positioned at the approximate center of the coverage area for a cell. Each horn antenna is assigned to communications coverage for one of the four ninety degree sectors. Cells for a typical cellular application are positioned on a triangular or square grid spacing to provide maximum coverage of a geographical location while minimizing the possibility of transmission loss as a mobile user moves from one cell to the next adjacent cell.

FIG. 1 is a diagram illustrating a representative example of 360 degree communications coverage for a cell, which is achieved by the overlap of four horn antennas exhibiting ninety degree half power azimuth beamwidths. Sectors beams 102, 104, 106, and 108 overlap at cross-over points 110, 112, 114, and 116, thereby forming overlap regions 118, 120, 122, and 124. A circle (shown by dashed lines) having a diameter $D_O$ connects the cross-over points 110, 112, 114, and 116 and illustrates the useful gain of the 360 degree coverage pattern achieved by the sector horns. Specifically, the gain of a sector horn above the level defined by the diameter $D_O$ represents excess gain that is not useful for a cellular communications application because of possible interference with overlapping the coverage of adjacent cells within the geographical coverage area. For example, excess gain can have a harmful effect on frequency division multiple access (FDMA) and time division multiple access (TDMA) applications because interference can be generated within overlapping neighbor cells using the same frequency band or in use at the same time.

In view of the foregoing, there is a need in the art for azimuth beam shaping for a horn antenna used for cellular communication applications. There is a further need for a sector antenna exhibiting a square "flat-top" beam having a peak gain over a ninety degree field of view, wherein the peak gain is less than the excess gain level exhibited by prior sector horn antennas. A combination of these improved antennas, each covering a ninety degree sector to support the overall coverage objective of 360 degrees, would preferably exhibit higher minimum gain in the desired cell sector area and lower interfering gain in adjacent cells.

Designers of cellular communication systems also rely upon antennas exhibiting a shaped beam in the elevation plane because elevation beam shaping supports the control of front-to-back cellular coverage. For example, the use of an antenna characterized by a narrow elevation beam pattern with sidelobe nulls for a cellular communications application can result in undesirable "holes" or open areas for cellular coverage. In contrast, use of an antenna characterized by a wide beamwidth in the elevation plane for a cellular communications application typically results in a significant reduction of range coverage when compared to the narrow beamwidth antenna. This is a result of a reduction of gain associated with a corresponding increase in elevation beamwidth for the wide beamwidth antenna. To achieve a desired cellular coverage range (or gain) while reducing coverage dropout as a result of elevation pattern nulls, there is a need for an antenna exhibiting an elevation beam pattern having shaped beam with minimal sidelobe nulls.

In summary, there is a need for a cellular communications antenna having adjustable shaping of the beam pattern in the azimuth plane and/or the elevation plane. There is a further need for an antenna characterized by a square "flat-top" beam in the azimuth plane and a peak gain that is consistent over a predetermined field of view. There is a further need for an antenna exhibiting a shaped or "$CSC^2$" beam pattern within the elevation plane and minimal sidelobe nulls along the lower pattern edge.

SUMMARY OF THE INVENTION

The present invention meets the needs described above by providing an antenna characterized by an approximate square or "flat-top" beam within the azimuth plane for a predetermined field of view. This improved antenna, typically a horn antenna, is useful for cellular communication applications in which multiple antennas are assigned sector coverage areas to accomplish an overall 360 degree coverage cell. In this representative example, the "flat-top" azimuth beam of the improved horn antenna results in reduced peak gain bleeding into adjacent cells and increased minimum gain in the desired cell sector. By minimizing gain overlap, the improved horn antenna provides an advantage of reducing interference with neighboring cells using the same frequency band for FDMA/TDMA applications. In this manner, the improved horn antenna can contribute to effective and efficient wireless communications for a 360 degree coverage area in a cell-based wireless communication system.

For one aspect of the present invention, a horn-type antenna comprises an input port for accepting an electromagnetic signal and a flared opening or output slot for transmitting the electromagnetic signal. An azimuth lens including at least a pair of lens elements can be placed proximate to the flared opening for adjusting the antenna beam pattern within the azimuth plane. Each lens element, typically having a cylindrical shape and comprising a dielectric material, supports the formation of a discrete beam in the azimuth plane in response to the electromagnetic signal output by the flared opening of the horn antenna. The discrete beams generated by these lens can sum to form a composite beam having a shape or pattern generally defined by the characteristics of the lens elements. Specifically, the beamwidth of each discrete beam generated by a lens element and the beam scan can be controlled by varying the size dimension of each lens element. Moreover, varying the physical separation between each pair of lens elements results in a modification of the scanning direction of the discrete beams. In this manner, the beam pattern for the composite beam in the azimuth plane can be varied to adapt to the operating environment or the specific wireless communications application for the horn antenna.

Turning now to a representative example of the improved horn antenna, the azimuth lens can include a parallel pair of spaced-apart cylindrical lens elements that extend across the length and in front of the output slot. Each cylindrical lens element can generate a discrete beam pointed off-boresight in response to the electromagnetic signal output from the output slot. The discrete beams formed by the cylindrical lens pair sum to generate a composite beam within the azimuth plane. Because the discrete beams are in-phase, they combine in a coherent fashion to form the composite beam. By varying the diameter of a cylindrical lens, the beamwidth of the corresponding discrete beam and beam scan can be controlled. Varying the distance or gap between the two cylindrical lenses also results in changes to the scanning direction of the discrete beams generated by these lens elements. Consequently, by controlling both the gap separating the pair of cylindrical lens and the diameter of these lens, a composite beam characterized by a square or "flat-top" pattern can be achieved by the improved horn antenna. Significantly, the cylindrical lens extending across and in front of the flared opening of the horn antenna can shape the beam within the azimuth plane without affecting the shaping of the beam in the elevation plane. This beam shaping is affected by the constant cross-section of the cylindrical lens elements.

The azimuth beam shaping approach of the present invention can be implemented for a horn antenna in an economical manner because dielectric material for the azimuth lens can be extruded or injection-molded to form the desired shape and length of each lens element. In addition, the composite beam generated by the horn antenna employing this lens-based azimuth beam shaping technique can be adjusted within a field environment by adjusting the distance separating a pair of azimuth lens elements. The shaping of the beam in the elevation plane can be accomplished prior to the azimuth lens location without affecting the shaping of the azimuth beam by the lens elements. Moreover, broadband performance by both H-plane and E-plane flare horns can be accomplished by the use of the azimuth lens. For vertical polarization, the dual cylindrical lens can be positioned in front of an E-plane flare horn. Similarly, the pair of cylindrical lens can be placed in front of an H-plane flare horn to achieve horizontal polarization.

Turning now to another aspect of the present invention, an elevation lens comprising a dielectric material can be placed within the flared section of the horn antenna to shape the elevation beam generated by this antenna. The flat edge of a hyperbolic-shaped lens is typically positioned along the edge of the flared opening of the horn antenna and the curved portion of the lens is positioned within the flared section and faces the input port of the horn antenna. However, the position of the elevation lens within the horn structure can be varied to affect the shape of the elevation beam pattern. In particular, the elevation lens can be rotated by a predetermined rotation angle within the parallel plate structure of a conventional E or H-plane flared horn to influence the shape of the elevation beam generated by this improved horn antenna.

These and other aspects, features, and advantages of the present invention may be more clearly understood and appreciated from a review of the following detailed description of the disclosed embodiments and by reference to the appending drawings.

DETAILED DESCRIPTION OF THE EXEMPLARY EMBODIMENTS

The present invention is directed to improvements for a horn antenna to accomplish controlled shaping of beam patterns within the azimuth and/or elevation planes. Briefly described, two or more spaced-apart dielectric lens can be positioned proximate to the output slot or flared opening of a horn antenna, thereby resulting in the generation of discrete beams associated with each of the lens. These discrete beams are in-phase and can coherently combine to form a composite beam within the azimuth plane. By controlling the spacing between the dielectric lens and/or varying the size and/or shape of each lens, the pattern for the composite beam in the azimuth plane can be shaped to accomplish a desired communications objective. For example, a pair of parallel, spaced-apart cylindrical lens can extend across and be centered in front of an output slot of a horn antenna to produce a composite beam having a "flat-top" or square beam pattern in the azimuth plane over a predetermined field of view to support sector coverage for cellular communication applications.

The present invention further supports controlling the shape of an antenna beam pattern within the elevation plane by varying the position of an elevation lens within the structure of the horn antenna. For a horn antenna having a parallel plate structure, a dielectric lens having a hyperbolic shape can be placed within the interior of the hornshaped structure and between the input port and the output slot to support elevation beam shaping. For a representative example of an initial elevation lens placement, the flat edge of the hyperbolic lens can be placed along the edge of the output slot and the curved portion of the lens can be placed within the interior of the horn-shaped structure and facing the input port. By rotating the position of the hyperbolic lens within the horn-shaped structure, the shape of the elevation beam pattern can be adjusted to accomplish a desired wireless communications objective. This elevation beam shaping can be accomplished without affecting the beam pattern in the azimuth plane.

Exemplary embodiments of the present invention will be described below with respect to a conventional horn antenna having a parallel-plate structure encompassing a flared section extending between a waveguide input port and an output slot or flared opening. Those skilled in the art will appreciate that the inventive aspects illustrated by these exemplary embodiments can be extended to other types of horn antennas and may be practiced at microwave and millimeterwave frequency ranges. Those skilled in the art will recognize that the instant invention also may be implemented with other antenna configurations.

Figure 2:
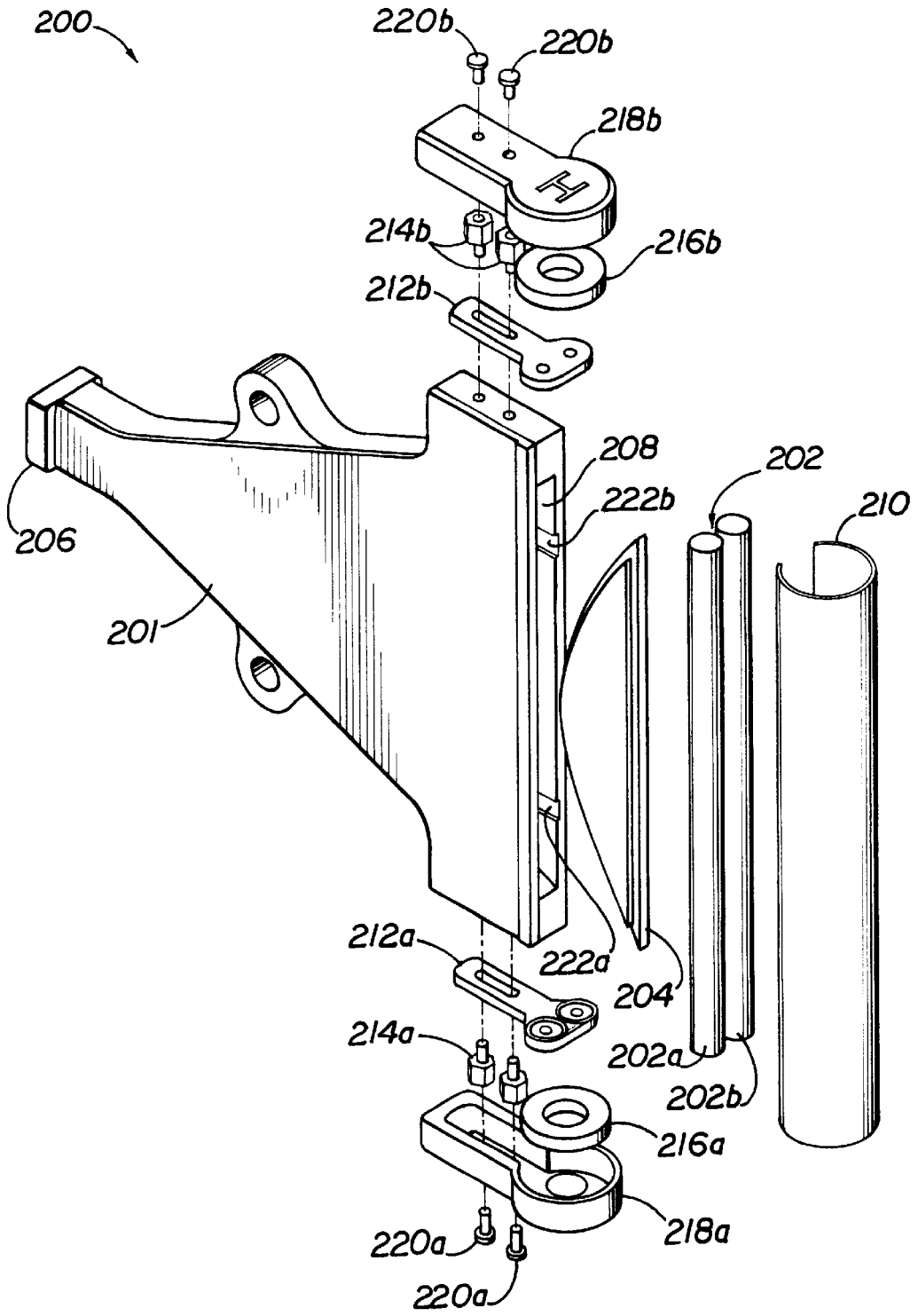
FIG. 2 is an exploded view illustrating the basic components for a horn antenna constructed in accordance with an exemplary embodiment of the present invention.
Figure 3:
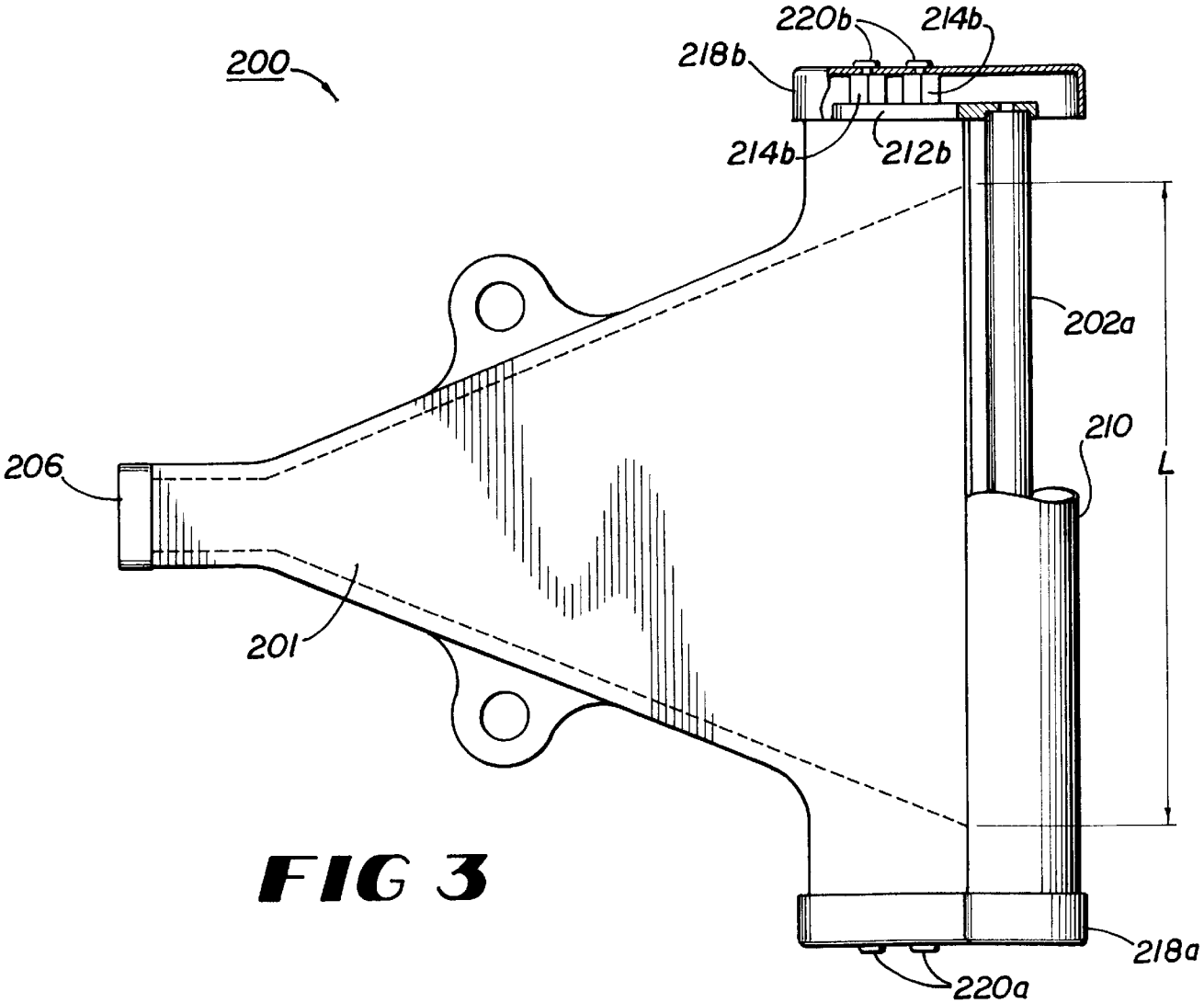
FIG. 3 is a side view of the horn antenna shown in FIG. 2.
Figure 4:
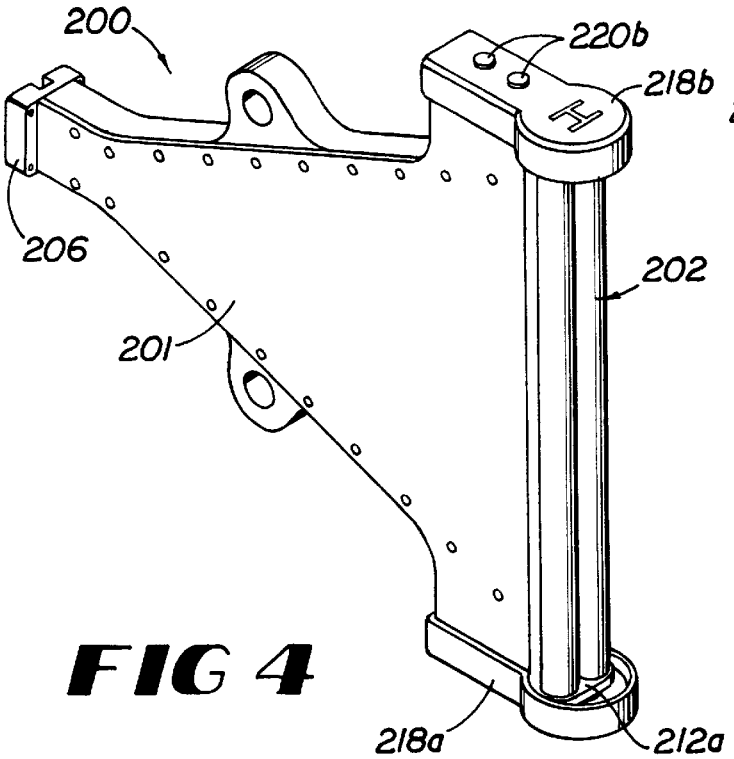
FIG. 4 is an isometric view of the assembled horn antenna shown in FIG. 2.
Figure 5:
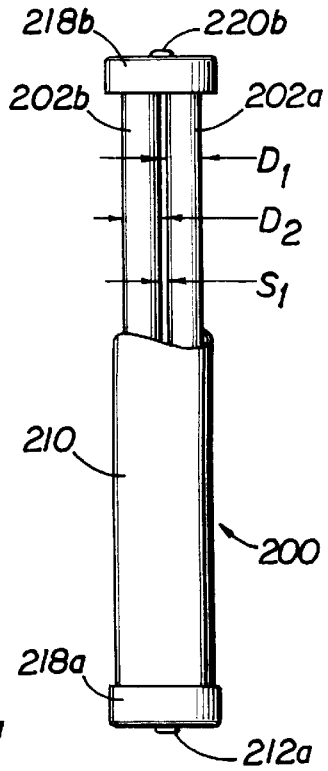
FIG. 5 is a front view of the horn antenna shown in FIG. 2.
Figure 6:
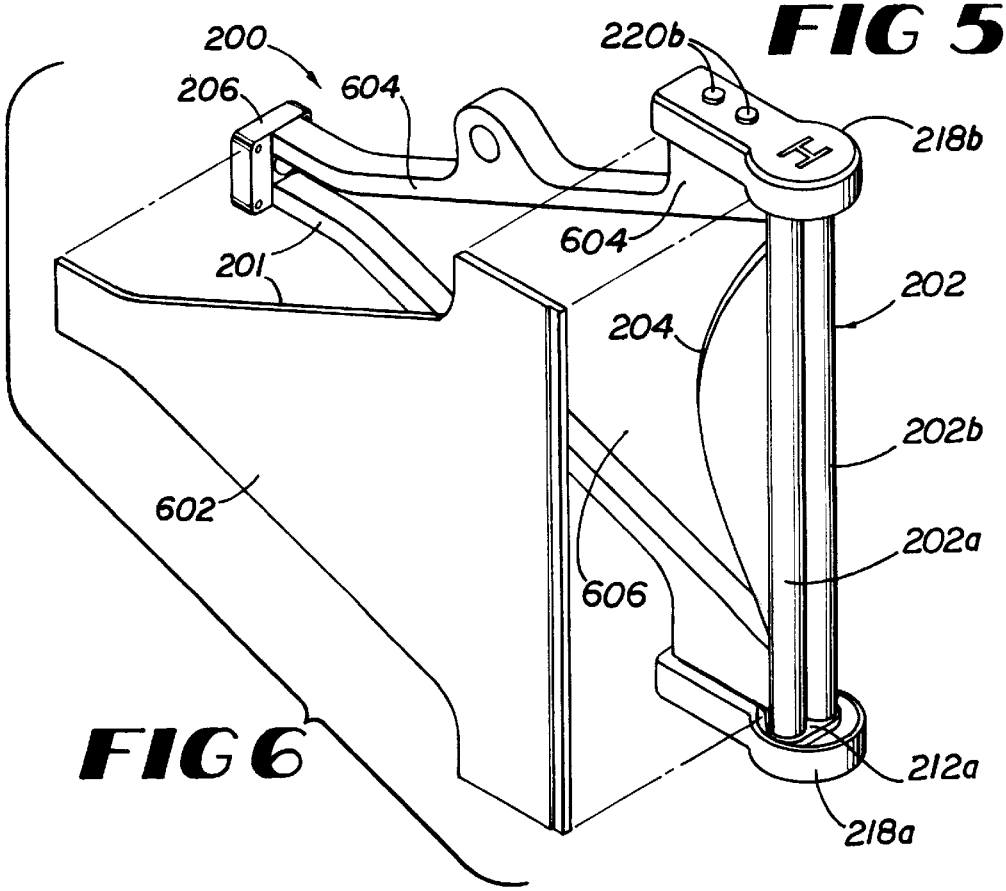
FIG. 6 is an isometric view illustrating the interior of the flared section of the horn antenna shown in FIG. 2.

FIG. 2 presents an "exploded" view of an antenna comprising a horn antenna, an azimuth lens comprising lens elements, and an elevation lens for shaping the beam patterns within the azimuth and elevation planes. FIGS. 3, 4, and 5 illustrate side, isometric (without radome) and front views of the assembled antenna, respectively. FIG. 6 is a diagram illustrating the flared interior section of the antenna and the placement of the elevation lens within this flared section. Those skilled in the art will appreciate that these alternative views of the antenna features support an understanding of critical components and their assembly for implementing the inventive aspects of this antenna.

Turning first to FIG. 2, an antenna 200 comprises an H-plane horn antenna 201, an azimuth lens 202 including a pair of parallel, spaced-apart cylindrical lens elements 202*a* and 202*b*, and an elevation lens 204. The azimuth lens 202 is useful for shaping the beam pattern for the horn antenna 201 in the azimuth plane, whereas the elevation lens 204 can shape the beam pattern for the horn antenna 201 in the elevation plane. The pair of azimuth lens elements 202*a* and 202*b* are positioned in front of a flared opening 208, also described as an output slot, and span the distance of the opening of this output slot. The elevation lens 204 preferably has a hyperbolic shape and fits within the enclosed, flared section of the horn antenna 201. Specifically, the flat edge of the elevation lens 204 is typically positioned adjacent to the opening of the output slot 208 and the remaining curved portion of the elevation lens 204 fits within the parallel plate structure enclosing the flared section of the horn antenna 201. In this manner, the apex of the curved section for the elevation lens 204 is directed toward an input port 206 for the horn antenna 201, whereas the flat base of the elevation lens 204 spans the distance of the opening for the slot output 208.

As best shown in FIGS. 2 and 3, the lens elements 202*a* and 202*b* are held in place adjacent to the output slot 208 by bracket assemblies positioned on the top and bottom of the flared section of the horn antenna 201. Each bracket assembly comprises a mounting bracket 212*a*(*b*), a pair of stand-offs 214*a*(*b*), and a pair of screws 220*a*(*b*). The pair of lens elements 202*a* and 202*b* are securely fixed in front of the output slot 208 by the mounting brackets 212*a* and 212*b*, which encompass the ends of the lens elements 202*a* and 202*b*. The lens elements 202*a* and 202*b* can be centrally positioned in front of the face of the output slot 208. The brackets 212*a* and 212*b* are attached to each side of the horn antenna 201 by the combination of the stand-offs 214*a* and 214*b*, radome caps 218*a* and 218*b*, and the screws 220*a* and 220*b*. Each pair of stand-offs 214*a* and 214*b* extend within a mounting slot of one of the mounting brackets 212*a* and 212*b* and attach to a side of the horn antenna 201, preferably proximate to the face of the output slot 208.

A radome 210, typically comprising a polyester/glass composite from Stevens Products, Inc., or equivalent material that is substantially transparent to the transmission and reception of electromagnetic signals, is attached to the output side of the horn antenna 201. The radome 210 serves to protect the azimuth lens 202, the elevation lens 204 and the output slot 208 from the operating environment of the horn antenna 201.

Prior to attaching the radome 210 to the horn antenna 201, radome cap plugs 216*a* and 216*b* can be attached to the open ends of the radome 210. In turn, the ends of the radome 210 can be positioned between the radome caps 218*a* and 218*b* for attaching the open face of the radome to the output side of the horn antenna 201. The screws 220*a* and 220*b* extend through mounting holes on the radome caps 218*a* and 218b for fastening to corresponding mounting holes in the stand-offs 214*a* and 214*b*. The combination of radome cap plugs 216*a* and 216*b* and the radome caps 218*a* and 218*b* operates to close each open end of the radome 210, thereby preventing moisture and other environmental effects from entering the radome 210. In this manner, both the azimuth lens 202 and the output slot 208 are protected from the operating environment of the horn antenna 201 by the radome 210.

Turning now to FIG. 6, this diagram illustrates the internal structure of the H-plane horn antenna 201 and highlights the parallelplate structure for this flared horn antenna. The horn antenna 201 comprises a shaped flat plate 602 and a flared horn section 604 having a flared section or compartment 606. The plate 602 can be attached to the flared horn section 604 in a conventional manner, thereby enclosing the flared section 606 and forming a waveguide structure operable as a passive transmission device. The input port 206 is located at one end of the flared horn section 604, whereas the much larger output slot 208 (not shown) is positioned at the opposite side of the flared horn section 604. The flared section 606 extends between the input port 206 and the output slot 208. The azimuth lens 202 is positioned in front of the horn antenna 201, which is formed by the combination of the plate 602 and the flared section 604, preferably at the face of the output slot 208. The elevation lens 204 can be positioned within the flared section 606, preferably adjacent to the output slot 208 and extending into the flared section 606 toward the input port 206. A portion of the flared section 606 is not occupied by the elevation lens 204, particularly the narrower neck of the flared section that is located opposite the output slot 208. Those skilled in the art will appreciate that the implementation shown for the horn antenna 201 in FIG. 6 is a representative example, and that the present invention encompasses other horn antenna structures.

Referring now to FIGS. 3, 4, and 5, the azimuth lens 202 comprises a pair of cylindrical lens elements 202*a* and 202*b*, each comprising a dielectric material, such as methylpentane available from Mitsui Plastics as "TPX-845" dielectric material. Each lens element 202*a*and 202*b* is positioned adjacent to the face of the horn antenna 201 and extends along the length of the output slot 208 (FIG. 2). The lens elements 202*a* and 202*b* are preferably positioned parallel to each other and are spaced-apart by a predetermined distance gap that is defined by the desired shaping of the azimuth beam pattern. This azimuth beam shaping approach be implemented for a horn antenna in an economical manner because the dielectric material for the azimuth lens elements 202*a* and 202*b* can be extruded or injection-molded to form the desired shape and length of each lens element.

The dimensions of each lens element 202*a* and 202*b* also can affect the characteristics of the corresponding discrete beams, thereby shaping the composite beam pattern for the antenna 200. Although a pair of cylindrical lens are shown in FIGS. 2–6, it will be understood that other shapes of azimuth lens elements can be implemented to achieve the inventive beam shaping technique of the present invention. Moreover, the present invention encompasses physical dimensions for the azimuth lens elements 202*a* and 202*b* that can differ from the identical diameters and lengths shown for the exemplary embodiment in FIGS. 2–6.

Broadband performance by H-plane and E-plane horn-type antennas can be accomplished by the use of an azimuth lens for beam shaping in the azimuth plane. For vertical polarization, the azimuth lens can be positioned in front of an E-plane flare horn. Similarly, the azimuth lens can be placed in front of an H-plane flare horn to achieve horizontal polarization.

As best shown in FIG. 3, each lens element 202*a* and 202*b* has an aperture length L. For an H-plane flare horn antenna operating at the frequency range of 24.25 GHz to 26.25 GHz, the aperture length is 5.47 inches for a 6 to 6.5 degree elevation beamwidth. The aperture length is reduced to 3.933 inches for an E-plane flare horn with the same elevation beamwidth and frequency of operation.

As best illustrated in FIG. 5, the lens element 202*a* has a diameter $D_1$, whereas the lens element 202*b* has a diameter $D_2$. For the preferred embodiment, the lens elements 202*a* and 202*b* have equal diameters, i.e., $D_1=D_2$. For the horn antenna 201 operating at the 25.25–26.25 frequency range, the diameter for the lens elements 202*a* and 202*b* is 0.375 inches. The lens elements 202*a* and 202*b* are positioned parallel to each other and spaced apart by a gap $S_1$. The gap $S_1$ is set to 0.062 inches to achieve a "flat-top" beam having maximum gain over a ninety degree azimuth field of view for an E-plane flare horn antenna operating in the frequency range of 24–26 GHz. For the H-plane flare horn antenna counterpart, the gap $S_1$ is set to 0.032 inches.

Figure 1:
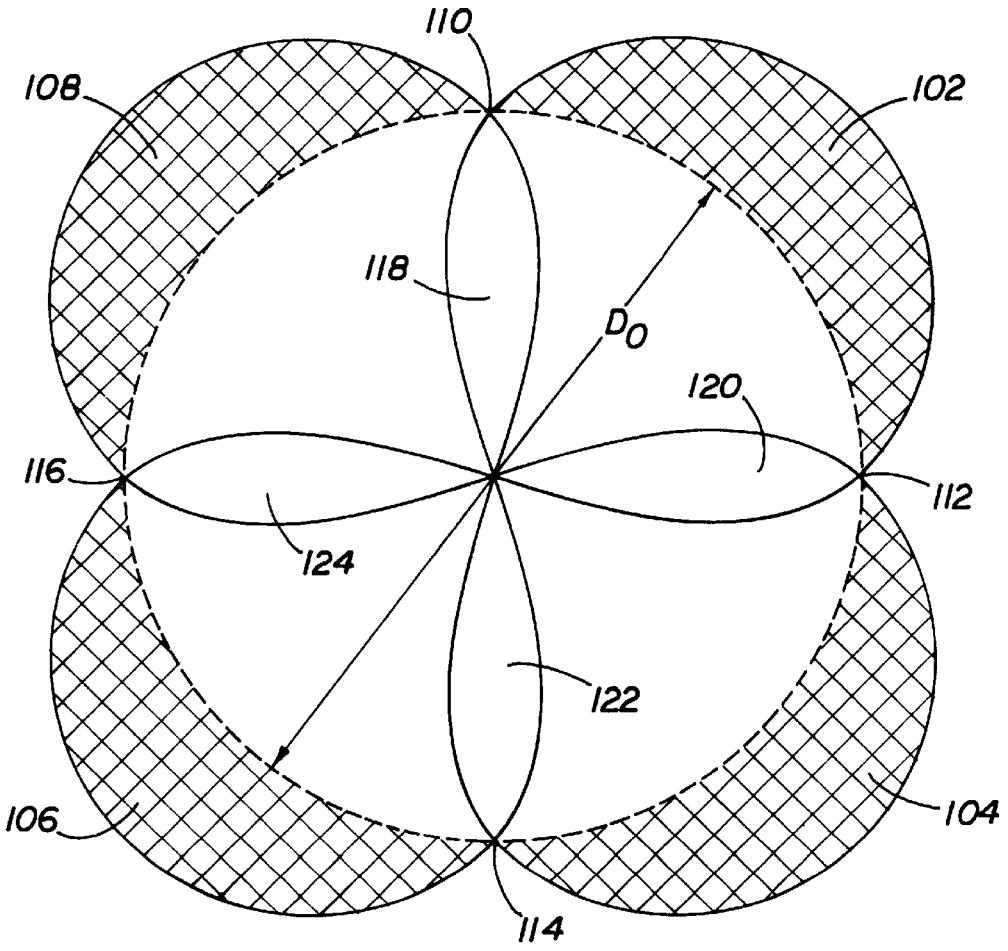
FIG. 1 is an illustration showing a typical 360 degree coverage area for a conventional cellular communications system employing four-ninety degree azimuth beamwidth horns.

Each lens element of the azimuth lens 202 responds to an electromagnetic signal output by the output slot 208 (FIG. 1) by generating a discrete beam pointed off boresight of the horn antenna 201. The diameters $D_1$ and $D_2$ for the cylindrical lens elements affect the beamwidth and beam scan for each beam. In addition, the gap $S_1$ for the space separating the lens element 202*a* from the lens 202*b* can determine the scanning direction of the discrete beams generated by the azimuth lens 202. It will be appreciated that the discrete beams are in-phase and, consequently, these discrete beams can coherently combine to form a composite beam for the horn antenna 201. By controlling both the diameter and the spacing for the lens elements 202*a* and 202*b*, the shape of the beam pattern in the azimuth plane can be controlled. In this manner, the beam pattern within the azimuth plane for the horn antenna can be varied by adjusting selected characteristics of the azimuth lens 202, namely the diameters $D_1$ and $D_2$ and the gap $S_1$.

Figure 7A:
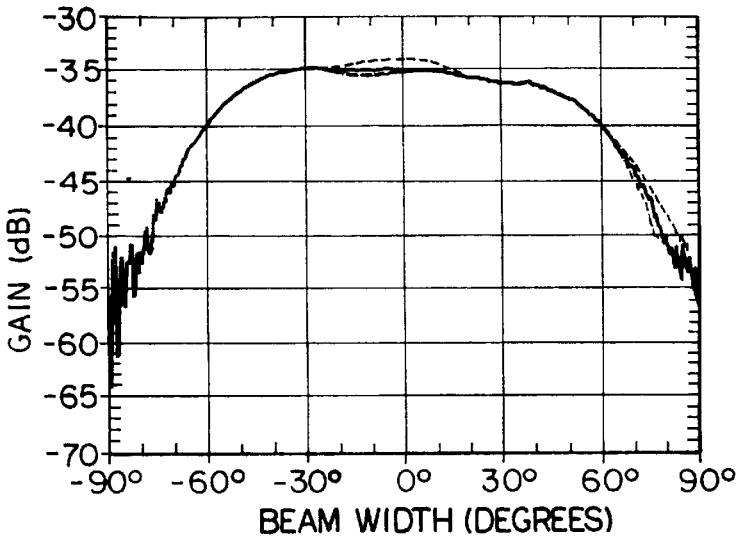
FIGS. 7A, 7B and 7C, collectively described as FIG. 7, are antenna patterns illustrating the variation of beam shaping within the azimuth plane for a horn antenna constructed in accordance with an exemplary embodiment of the present invention.
Figure 7B:
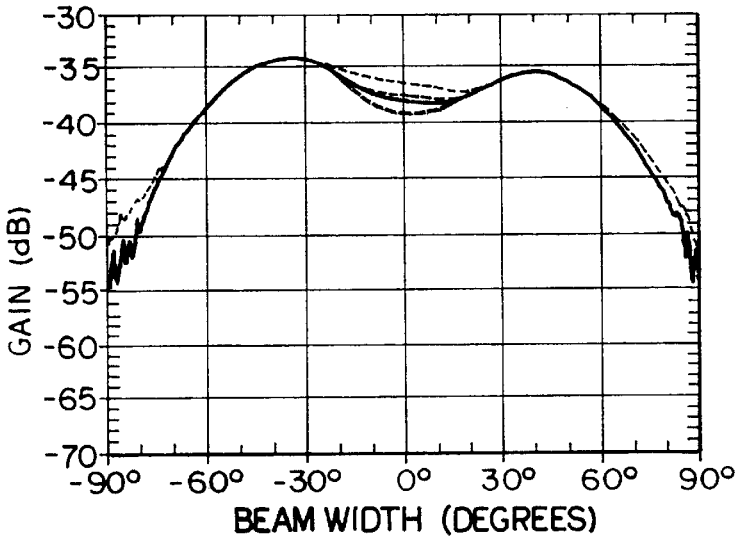
Figure 7C:
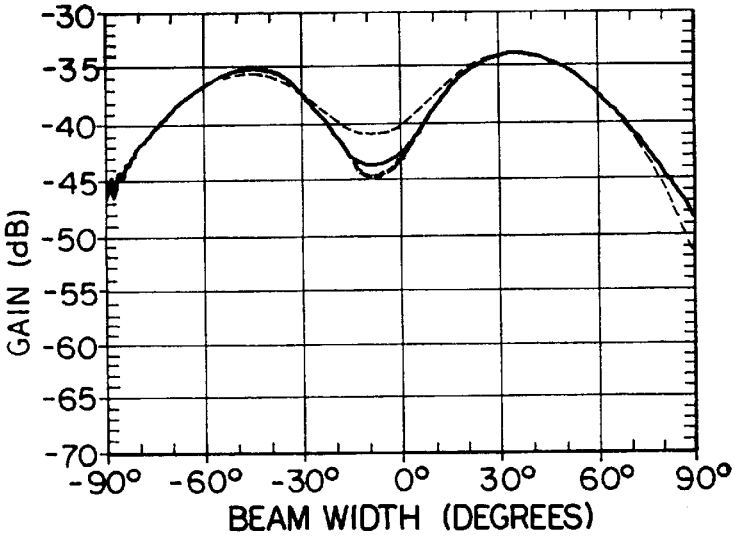

Turning now to FIG. 7A, 7B, and 7C, representative antenna patterns illustrate the effect of varying the characteristics of the azimuth lens 202 upon the antenna beam within the azimuth plane. FIG. 7A depicts the beam pattern for an H-plane horn when the diameters $D_1$ and $D_2$ for the lens element 202*a* and 202*b* are substantially identical and the gap $S_1$ is set to a distance for generating a composite beam having a "flat-top" gain characteristic over the ninety degree field of view. Because the diameters of the cylindrical lens elements 202*a* and 202*b* are equal, this spacing or gap $S_1$ between the lens elements can be empirically determined for the selected frequency range and gain. Specifically, the gap $S_1$ can be varied until the discrete beams associated with each lens element 202*a* and 202*b* coherently combine in-phase to form the flat-top beam pattern shown in FIG. 7A. This "flat-top" azimuth beam pattern results in minimal gain overlap with adjacent cells of a typical grid-based cell layout. By minimizing gain overlap, the horn antenna exhibiting this azimuth pattern provides an advantage of reducing interference with neighboring cells cell-based wireless communication system using the same frequency band for FDMA/TDMA applications.

For the beam patterns shown in FIGS. 7B and 7C, the diameters $D_1$ and $D_2$ are equal and the gap $S_1$ is set to a distance that is greater than the distance separating the azimuth lens elements 202*a* and 202*b* for the H-plane horn antenna associated with FIG. 7A. FIGS. 7B and 7C illustrate that an increase in the gap $S_1$, when compared to the distance separating the lens elements 202*a* and 202*b* for the H-plane horn antenna of FIG. 7A, will result in a minimum gain value at the approximate center of the beam pattern. In summary, when the diameters $D_1$ and $D_2$ for the lens elements 202*a* and 202*b* are equal, variation of the gap $S_1$ can result in different beam shapes in the azimuth plane over a relatively wide field of view for an antenna, such as the horn antenna 201. Those skilled in the art will appreciate that the azimuth beam shapes for an E-plane horn antenna should be similar to the beam patterns illustrated in FIGS. 7A, 7B, and 7C for the H-plane horn antenna counterpart.

In view of the impact that the distance for the gap $S_1$ has upon the beam pattern within the azimuth plane, an alternative embodiment of the inventive antenna assembly can include a mechanism for adjusting the gap $S_1$ within the operating environment of the antenna. For example, a set screw could be used to vary the gap $S_1$ between lens elements in a real-time fashion when this adjustment is required during installation or maintenance of the antenna. In this manner, the composite beam generated by the horn antenna employing this inventive lens-based azimuth beam shaping technique can be adjusted within a field environment by adjusting the distance separating a pair of azimuth lens elements.

Although the embodiments described above with respect to FIGS. 1–6 are implemented with a pair of cylindrical lens elements, it will be understood that the inventive concept for varying the beam pattern of an antenna within the azimuth plane can be extended to the use of multiple lenses, i.e., two or more lens elements comprising a dielectric material. In addition, the present invention encompasses shapes other than a cylindrical shape or form for the azimuth lens elements. Alternative embodiments encompass placement of the azimuth lens elements in front of the output slot of the horn antenna in a manner that is off-center with the output slot. In particular, an alternative embodiment can be implemented by a pair of azimuth lens elements positioned proximate to and in front of the output slot, wherein the spacing or separation between the lens elements is not centered with the center point of the output slot.

Figure 8A:
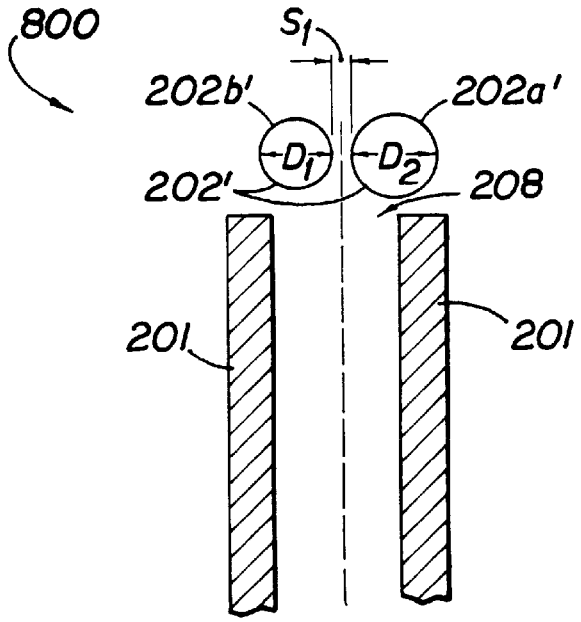
FIG. 8A is a diagram illustrating a pair of cylindrical lens elements having different diameters and positioned adjacent to the output slot of a horn antenna in accordance with an exemplary embodiment of the present invention.

FIG. 8A is a diagram illustrating an azimuth lens 202' comprising lens elements 202*a*' and 202*b*', each having a cylindrical shape and a different diameter. The lens elements 202*a*' and 202*b*' are positioned at the face of the output slot 208 and are positioned at the approximate centerpoint (shown by dashed lines) of this output slot. The lens element 202*a*' has a diameter $D_2$, whereas the lens element 202*b*' has a diameter $D_1$. As clearly shown in FIG. 8A, the diameter $D_2$ is larger than the diameter $D_1$. A spacing or gap $S_1$ separates the lens element 202*a*' from the smaller lens element 202*b*'. This cross-section view of the antenna 800 highlights the parallel-plate waveguide structure of the horn antenna 201, which comprises a conductive material such aluminum alloy 6061-T6.

Figure 8B:
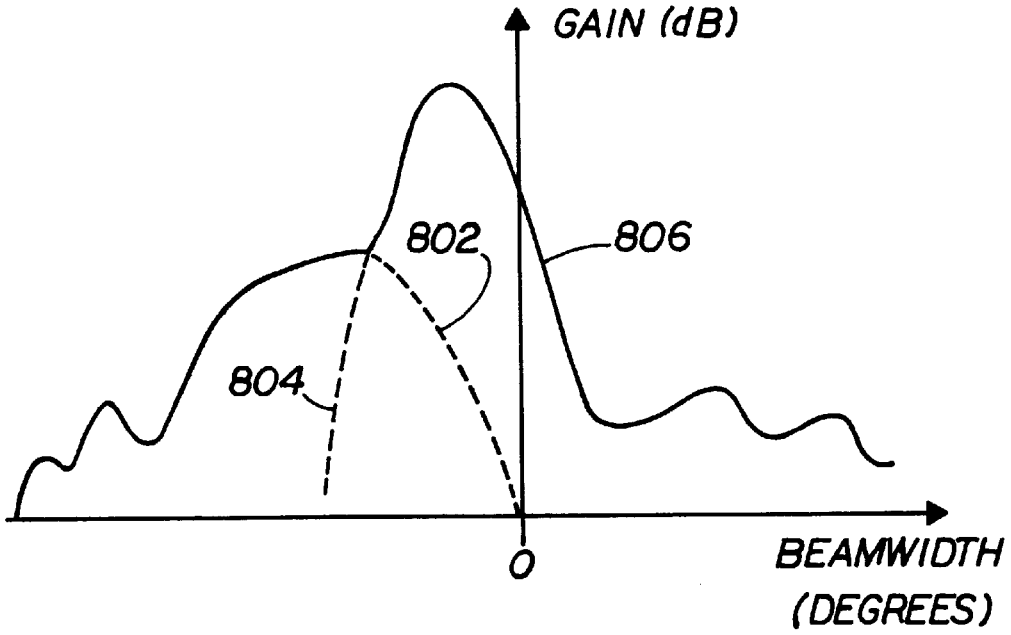
FIG. 8B is an antenna pattern illustrating a composite azimuth beam formed by the summation of discrete beams generated by a horn antenna employing the azimuth lens elements illustrated in FIG. 8A.

Turning now to FIG. 8B, a representative example of a beam pattern produced by the antenna 800 is shown to illustrate the beam shaping features of the azimuth lens elements 202*a*' and 202*b*'. The smaller lens element 202*b*' can generate a discrete beam 802, while the larger lens element 202*a*' can generate a discrete beam 804. A composite beam 806 is formed by summing in-phase the discrete beam 802 with the discrete beam 804 as determined by the operation of the azimuth lens 202. The shape of this composite beam 806 is affected by the different diameters of the cylindrical lens elements 202*a*' and 202*b*', as well as the distance extending across the gap $S_1$ between these lens elements. In view of the foregoing, it will be understood that an alternative embodiment of the present invention can include an azimuth lens having two or more lens elements with different sizes (and shapes).

Referring again to FIGS. 2 and 6, the elevation lens 204 comprises a dielectric material shaped in the preferred curved form of a hyperbola. Although the preferred dielectric material is methylpentane or a 2.0 dielectric constant material, those skilled in the art will appreciate that alternative dielectric materials can be substituted for implementing the elevation lens 204. As best shown in FIG. 2, the elevation lens 204 is inserted within the internal structure of the horn antenna 201, i.e., the flared section 604 and, for a static installation, aligned with tracks 222*a* and 222*b* at the edge of the output slot 208. For example, the elevation lens 204 can include a pair of posts (not shown) extending along one side of the lens element and corresponding to the placement of the tracks 222*a* and 222*b* within the flared section 604. Once inserted within the flared section 604, the posts (not shown) of the elevation lens element are aligned with the tracks 222*a* and 222*b* and the flat edge of the elevation lens element is thereby positioned at the face of the output slot 208. The curved section of the elevation lens 204 faces the input port 206 and is typically enclosed by the parallel structure of the horn antenna 201.

The exemplary embodiment shown in FIGS. 2 and 6 represents a static installation of the elevation lens 204, which compensates for phase errors resulting from the selected flare angle for the horn antenna 201. In particular, this static placement of the elevation lens 204 compensates for the gain loss resulting from phase errors associated with a relatively sharp flare angle (22.5 degrees) of the horn antenna 201.

Figure 9:
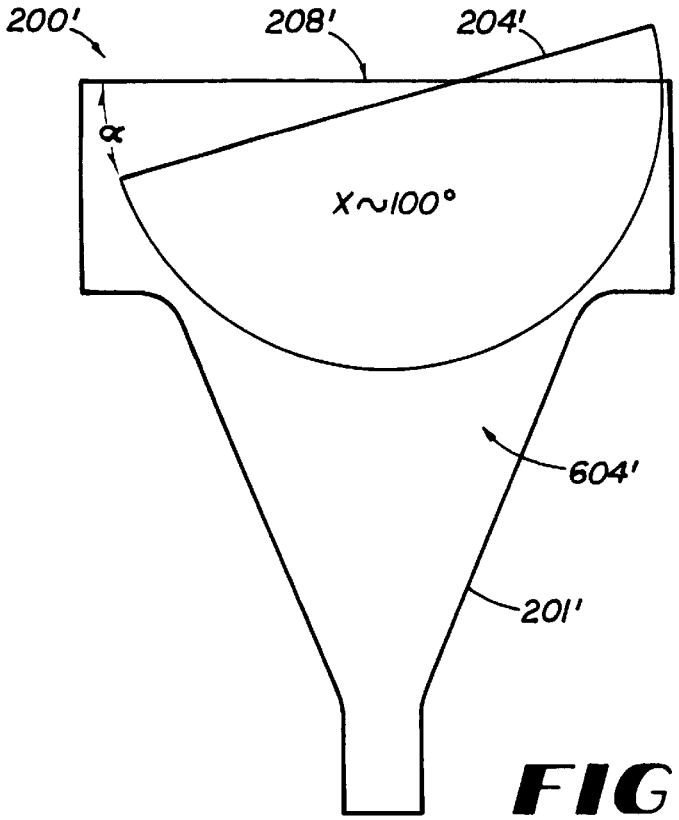
FIG. 9 is a diagram illustrating a representative placement of an elevation lens within the flared section structure of a flared horn antenna to accomplish shaping of the elevation beam in accordance with an exemplary embodiment of the present invention.

Certain antenna applications require the flexibility of adapting the elevation beam pattern for an antenna within a range of shapes over a broad field of view. In recognition of this need, the inventors have determined that varying the position of the elevation lens element within the flared section of a conventional flared horn antenna results in a range of elevation beam patterns in the elevation plane, while compensating for phase errors resulting from the selected flare angle for the flared horn antenna. FIG. 9 is a diagram illustrating a rotatable elevation lens that can rotate position within a flared section of a convention flared horn antenna. Referring now to FIG. 9, the position of an elevation lens 204' can be rotated within the flared section 604' of the horn antenna 201' to vary the shaping of the antenna beam within the elevation plane. For example, beam shaping within the elevation plane by the elevation lens 204' can be affected by tilting the lens element within the flared section 604' by a rotation angle a, as measured from the face of the output slot 208'. Significantly, the shaping of the beam in the elevation plane can be accomplished prior to the azimuth lens illustrated in FIGS. 1–6 without affecting the shaping of the azimuth beam by the lens elements.

Figure 10A:
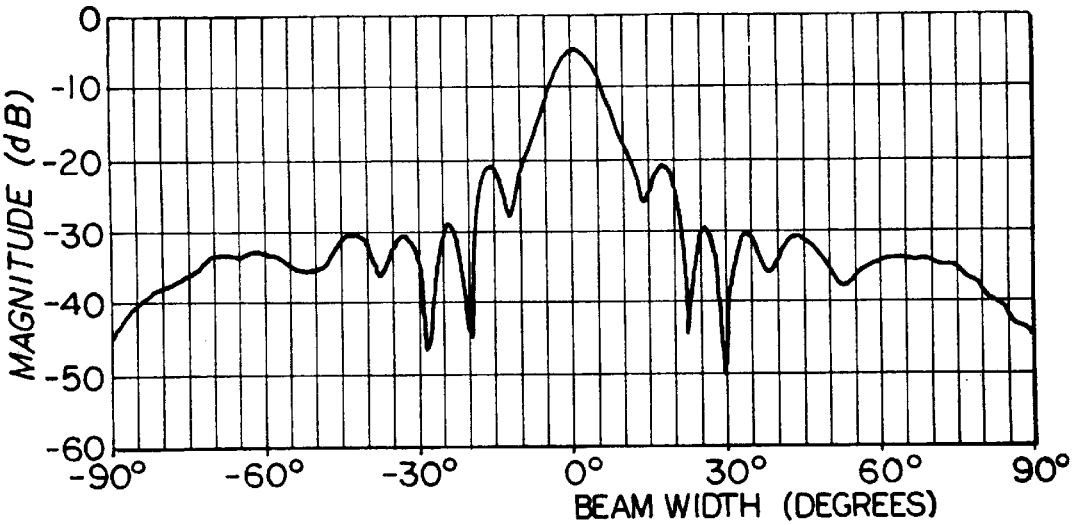
FIGS. 10A and 10B, collectively described as FIG. 10, are antenna patterns illustrating variations in the shaping of an elevation beam generated by a horn antenna employing an elevation lens in accordance with an exemplary embodiment of the present invention.
Figure 10B:
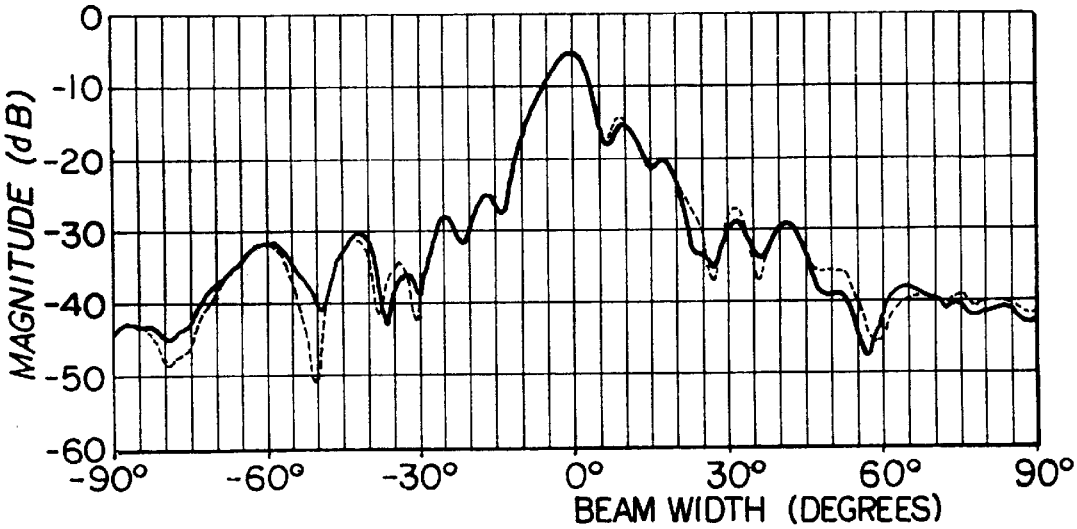

FIGS. 10A and 10B are illustrations of antenna patterns showing the effects of positioning an elevation lens within the internal flared section of a horn antenna upon the beam shape in the elevation plane. FIG. 9A illustrates the beam pattern in the elevation plane for a horn antenna that does not include an elevation lens that can rotate position within the internal horn assembly. i.e., a fixed installation of the elevation lens with rotation angle $\alpha=0$ degrees. This beam pattern represents a measurement of a flared horn antenna operating at 24.75 GHz and including a fixed installation of an elevation lens, such as the elevation lens 204. In contrast, FIG. 9B shows a pair of elevation beam patterns for this horn antenna, each representing different operating frequencies, after rotating the elevation lens within the enclosed flared horn section. For a rotation angle $\alpha=3$ degrees, the beamwidth remains constant in the elevation plane, but the upper and lower sidelobe levels change as a result of varying the position of the elevation lens 204' within the flared section of the horn antenna 201. Significantly, this rotation of position for the elevation lens 204' results in a filling of elevation beam pattern nulls because sidelobe levels for the upper sidelobes are reduced, whereas the sidelobe levels for the lower sidelobes are increased. This "filling" of pattern nulls effectively shapes the elevation beam pattern. The elevation beam pattern shown in a solid line represents measured antenna data at 24.75 GHz, while the elevation beam pattern shown in dashed lines represents measured antenna data at 25.25 GHz.

Figure 11:
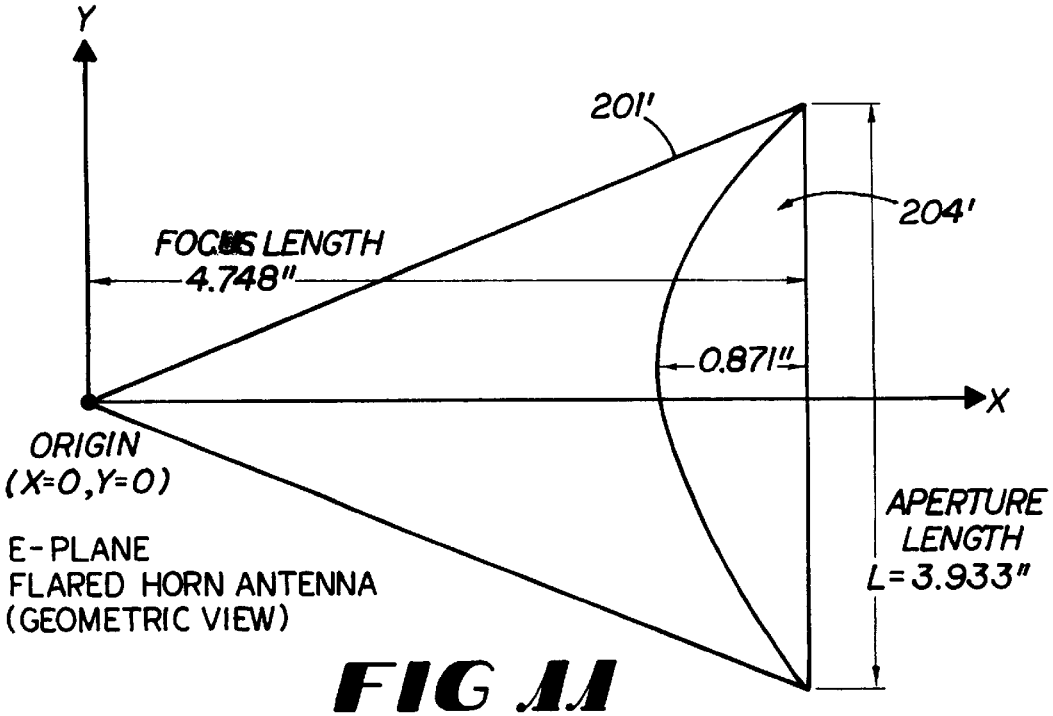
FIG. 11 is a diagram illustrating the hyperbolic shape of an elevation lens for an E-plane flared horn antenna in accordance with an exemplary embodiment of the present invention.

Turning now to FIG. 11, for an E-plane flared horn antenna, the elevation lens 204 (and 204') has a hyperbolic surface defined by design equation (1):

$$x=2.294+1.583[1+0.363y^2]^{1/2} \quad (1)$$

For this representative embodiment of the E-plane flared horn antenna, the flare angle (½ angle) is 223.5 degrees, the aperture length L is 3.933 inches, the rectangular waveguide width (WR-42) is 0.39 inches, and the focal length is 4.748 inches. The thickness of the elevation lens 204 (and 204') is 0.871 inches.

Alternative embodiments will become apparent to those skilled in the art to which the present invention pertains without departing from the spirit and scope of the instant invention. Accordingly, the scope of the present invention is described by the appended claims and is supported by the foregoing description.

What is claimed is:

1. An antenna comprising:

a waveguide terminating in an aperture and configured to emit electromagnetic energy having a main beam propagating substantially in a boresight path relative to the aperture; and a lens positioned adjacent to the aperture and in the path of the main beam, including at least two lens elements positioned side-by-side and spaced apart by a gap, the lens elements configured to divide substantially all of the main beam into a plurality of discrete far-field electromagnetic beams directed in off-boresight directions, with each far-field beam emanating from a corresponding lens element.

2. The antenna of claim 1, wherein the length of the gap between two adjacent lens elements is selected to obtain a desired off-boresight directional relationship between the far-field beams emanating from the corresponding lens elements.

3. The antenna of claim 1, wherein said lens elements comprise a dielectric material.

4. The antenna of claim 1, wherein said lens elements comprise substantially cylindrical dielectric components.

5. The antenna of claim 4, wherein said aperture has a length, said lens elements are at least about as long as the length of the slot.

6. The antenna of claim 1, wherein said aperture comprises an elongated slot.

7. The antenna of claim 1, wherein each lens element has a substantially cylindrical shape, a first lens element has a first diameter and a second lens element has a second diameter, said first diameter is substantially greater than said second diameter.

8. The antenna of claim 1, wherein each lens element has substantially cylindrical shape, a first lens element has a first diameter and a second lens element has a second diameter, the length of the gap is less than said first and said second diameters.

9. The antenna of claim 1, wherein each lens element is configured to emit a far-field discrete beam that is in phase with a neighboring far-field respective beam.

10. The antenna of claim 1, wherein said aperture has a length, each lens element has a length that is substantially equal to the length of said aperture.

11. The antenna of claim 1, wherein said aperture has a length and a width, each lens element has a substantially cylindrical shape and a diameter, and a sum of diameters of the lens elements is at least about as large as the width of said aperture.

12. The antenna of claim 1, wherein a size of said gap is selected to avoid a significant reduction in gain in the boresight direction.

13. The antenna of claim 1, wherein the length of said gap is selected such that discrete beams combine to form a composite beam that is characterized by a "flat-top" antenna pattern within an azimuth plane.

14. The antenna of claim 1, further comprising an elevation lens positioned within the waveguide and proximate to the aperture, the elevation lens operative to shape the antenna pattern in an elevational plane.

15. The antenna of claim 14, wherein the elevation lens is moveable within the waveguide to affect the shape of the antenna pattern in an elevational plane.

16. The antenna of claim 14, wherein the elevation lens includes a hyperbolic-shaped lens of dielectric material having a flat edge and a curved section, the flat edge of the hyperbolic-shaped lens positioned along an edge of the aperture and the curved portion of the hyperbolic-shaped lens positioned within the waveguide.

17. The antenna of claim 1, wherein the waveguide, aperture, and lens elements operate in a reciprocal manner to receive electromagnetic energy.

18. A method for adjusting an antenna beam pattern of an antenna having a waveguide terminating in an aperture, comprising the steps of:

emanating electromagnetic energy having a main beam propagating substantially in a boresight path relative to the aperture; and positioning a lens adjacent to the aperture and in the path of the main beam, the lens including at least two lens elements, the lens elements dividing substantially all of the main beam into a plurality of discrete far-field electromagnetic beams directed in off-boresight directions by positioning the lens elements side-by-side and spaced apart by a gap, with each far-field beam emanating from a corresponding lens element.

19. The method of claim 18, further comprising the step of selecting the length of the gap between two adjacent lens elements to obtain a desired off-boresight directional relationship between the far-field beams emanating from the corresponding lens elements.

20. The method of claim 18, wherein each lens element is substantially cylindrical in shape and has a diameter, the step of selecting the gap length includes selecting a gap length that is less than each diameter of said cylindrical elements.

21. The method of claim 18, wherein said aperture has a length, the method further comprising the step of sizing each lens element with a length that is substantially equal to the length of said aperture.

22. The method of claim 18, further comprising the step of configuring each lens element to emit far-field beams such that each far-field beam is substantially in phase with a neighboring beam.

* * * * *